US005848174A

United States Patent [19]

Ki et al.

[11] Patent Number: 5,848,174

[45] Date of Patent: Dec. 8, 1998

[54] LINEAR MOVEMENT SPEAKER SYSTEM

[76] Inventors: Young Do Ki, 704 W. 227th Pl., Torrance, Calif. 90502; Sang Wu Han, 18533 Rio Seco Dr., #C, Rowland Heights, Calif. 91748

[21] Appl. No.: 20,352

[22] Filed: Feb. 9, 1998

[51] Int. Cl.[6] ..... H04K 25/00

[52] U.S. Cl. ..... 381/404; 381/403; 381/405

[58] Field of Search ..... 381/403, 404, 381/405, 396, 398; 181/171, 172

[56] References Cited

U.S. PATENT DOCUMENTS 4,190,746 2/1980 Harwood et al. ..... 381/404
4,239,943 12/1980 Czerwinski ..... 381/403
4,379,952 4/1983 Kaizer et al. ..... 381/403
4,737,992 4/1988 Latham-Brown et al. .
5,123,053 6/1992 House .
5,139,242 8/1992 Yarr .

*Primary Examiner*—Huyen Le

[57] ABSTRACT

An inner suspension system for a speaker assembly comprising a center spider, an intermediate spider, and a linear spider. The system reduces distortion of the output from the speaker and increases axial integrity of the movement of the cone. The center spider and intermediate spider are disk shaped and are each attached to the frame of the speaker assembly and to different points on the voice coil former. The linear spider, on the other hand, is cylindrically shaped and is attached to the pole piece of the magnetic motor structure, and the cone converges upon the other end of the cylindrically shaped linear spider.

4 Claims, 1 Drawing Sheet

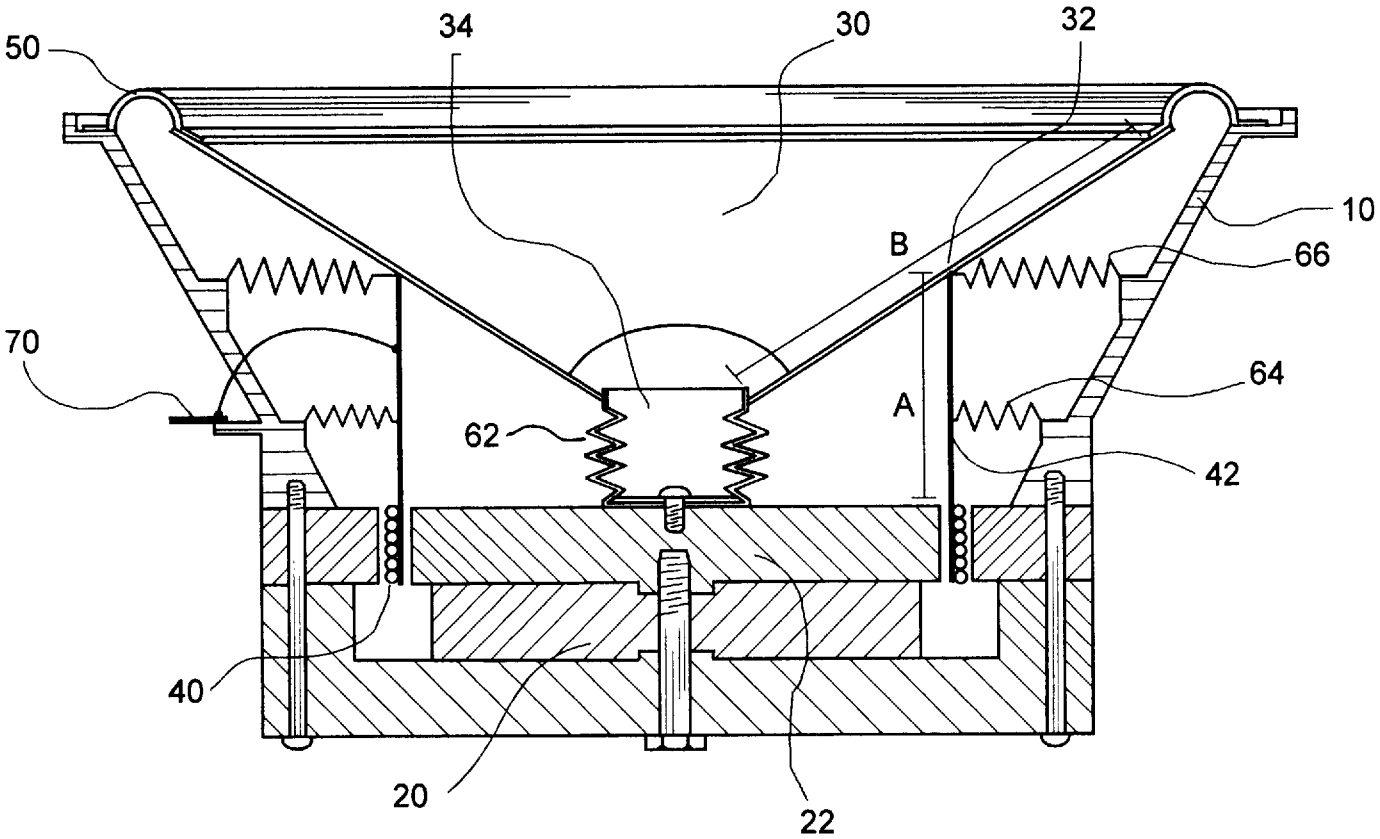
( FIG 1 )

LINEAR MOVEMENT SPEAKER SYSTEM

BACKGROUND OF THE INVENTION

1. Field of the Invention

The present invention pertains to the field of audio equipment, specifically to improved cone and dome drivers including an improved suspension system.

2. Description of the Prior Art

In speaker applications, the function of the inner suspension is to ensure that the motion of the voice coil assembly is basically constrained to the axial dimension, with minimal radial and rocking motions. Typically, the inner suspension is connected to the voice coil former, and the outer edge of the inner suspension is bonded to the frame. On conventional cone and dome drivers, the inner suspension coupled with the outer suspension, or surround, comprise the suspension system of the driver.

Prior art in the field of audio equipment teach several variations of suspension and damping systems. U.S. Pat. No. 5,123,053 to House discloses a transducer comprising a diaphragm including a perimeter, a motor for causing the diaphragm to vibrate in response to an electrical signal, and a surround and a frame for supporting the diaphragm from its perimeter to permit such motion.

U.S. Pat. No. 4,737,992 to Latham-Brown et al. discloses a loudspeaker driver having a spider covering rear basket opening.

U.S. Pat. No. 5,139,242 to Yarr discloses a linear suspension system which allows a relatively large axial stroke while also providing long life and high torsional and radial stiffness. Although these prior art teach methods of inner suspension for speaker assemblies, none teach an inner suspension system similar to that of the present invention.

Accordingly, the primary object of the present invention is to provide an inner suspension system that reduces the amount of distortion of the output from the speaker.

Another object of the present invention is to provide an inner suspension system that increases the axial integrity of the speaker assembly.

SUMMARY OF THE INVENTION

The present invention is an inner suspension system used in a speaker that prevents distortion while optimizing performance, referred to herein as the Linear Movement Speaker System (LMSS). The present invention comprises a linear spider, an intermediate spider, and a center spider. The linear spider is positioned axially with respect to the movement of the voice coil and is position directly behind the dome of the driver. The intermediate spider is connected to the cone midway between the dome (inner edge of the cone) and the surround (outer edge of the cone) The center spider is placed in a conventional position connected to the voice coil former. Speakers utilizing LMSS have reduced distortion without comprising performance of the driver.

These together with other objects of the invention are explained clearly in the claims annexed to and forming a part of this disclosure. For a better understanding of the invention, its operating advantages and the specific objects attained by its use, reference should be made to the accompanying drawings in which there are illustrated preferred embodiments of the invention.

BRIEF DESCRIPTION OF THE DRAWINGS

For a better understanding of the principle and nature of the present invention, reference should be made to the following detailed description taken in connection with the accompanying drawings in which:

FIG. 1 is a cross-sectional side view of the present invention depicting the structural position of each component of the inner suspension system.

DETAILED DESCRIPTION OF THE PREFERRED EMBODIMENT

Referring to FIG. 1, a typical cone and dome driver assembly comprises the frame 10, the magnetic motor structure 20, the cone 30, the voice coil 40 and the outer suspension 50. The present invention comprises an inner suspension system that further comprises the linear spider 62, the center spider 64, and the intermediate spider 66.

The center spider 64 comprises an apertured corrugated disk that may be made of open-weave cloth impregnated with phenolic resin and formed under heat. The corrugation of the disk comprises a plurality of peaks and troughs that form a concentric and integrally aligned pattern of rings extending from the outermost portion of the disk to the aperture at the center of the disk. The diameter of the circular aperture at the center of the disk corresponds to the diameter of the voice coil former 42, as the innermost edge of the center spider 64 is connected to the voice coil former. The outermost edge of the center spider 64 is connected to the frame 10. Referring to FIG. 1, the distance from the top of the voice coil 40 to the top of the voice coil former 42 is represented by A. The optimal position at which the center spider 64 contacts the voice coil former 42 is at the midpoint of A.

The intermediate spider 66 is similar to the center spider 64 but is positioned towards the outer edge of the cone 30 and thus has a larger diameter than that of the center spider 64. The intermediate spider 66 also comprises an apertured corrugated disk that may be made of open-weave cloth impregnated with phenolic resin and formed under heat. The innermost edge of the intermediate spider 66 may be connected to the cone 30 at the point 32 at which the voice coil former 42 also contacts the cone 30. The outermost edge of the intermediate spider 64 is connected to the frame 10. Referring to FIG. 1, the distance from the inner aperture 34 of the cone 30 to the outer suspension 50 is represented by B. The optimal position at which the center spider contacts the cone 30 is at the midpoint of B.

The linear spider 62 differs from the intermediate spider 66 and the center spider 64 because it is not shaped as a disk and is not connected to either the voice coil former 42 or the frame 10. The linear spider 62 comprises a cylindrical annulus that may be made of the same material as the previously described spiders, wherein the cylindrical annulus is longitudinally corrugated forming a pattern of rings along its length. The bottom end of the cylindrical annulus is connected to the pole piece 22 of the magnetic motor structure 20, and the cone 30 converges upon the top end of the cylindrical annulus.

In conventional speaker systems, the speaker terminal is connected to the cone itself. Referring to FIG. 1, the speaker terminal 70 is connected to the voice coil former 42 to decrease the detrimental effects of the movement of the cone upon the signal passing through the speaker terminal.

By providing increased suspension to the cone and optimizing axial integrity of the movement of the speaker assembly, LMSS reduces the amount of distortion created by the speaker and improves the sound pressure level generated by the speaker. In addition, LMSS reduces the wrinkles of the cone when subjected to a high power load. LMSS is particularly useful in applications where the speaker diameter exceeds 18 inches.

What is claimed as being new and therefore desired to be protected by Letters Patent of the United States is as follows:

1. An inner suspension system for a speaker assembly comprising:

a) a center spider;

1) said center spider comprising an apertured corrugated disk having an innermost edge and an outermost edge, wherein corrugation forms progressive rings to and from said innermost and outermost edges;

2) said innermost edge of said center spider connected to a voice coil former of a speaker assembly;

3) said outermost edge of said center spider connected to a frame of said speaker assembly;

b) an intermediate spider;

1) said intermediate spider comprising an apertured corrugated disk having an innermost edge and an outermost edge, wherein corrugation forms progressive rings to and from said innermost and outermost edges;

2) said innermost edge of said intermediate spider connected to a voice coil former of said speaker assembly;

3) said outermost edge of said intermediate spider connected to said frame of said speaker assembly;

c) a linear spider;

1) said linear spider comprising a longitudinally corrugated cylindrical annulus having an upper end and a lower end;

2) said lower end of said longitudinally corrugated cylindrical annulus connected to a pole piece of said speaker assembly;

3) a cone of said speaker assembly converging upon said upper end of said longitudinally corrugated cylindrical annulus.

2. An inner suspension system for a speaker assembly as mentioned in claim 1, wherein said center spider, said intermediate spider, and said linear spider are made of an open-weave cloth impregnated with phenolic resin and formed under heat.

3. An inner suspension system for a speaker assembly comprising:

a) a center spider;

1) said center spider comprising an apertured corrugated disk having an innermost edge and an outermost edge, wherein corrugation forms progressive rings to and from said innermost and outermost edges;

2) said innermost edge of said center spider connected to midpoint of a voice coil former of a speaker assembly;

3) said outermost edge of said center spider connected to a frame of said speaker assembly;

b) an intermediate spider;

1) said intermediate spider comprising an apertured corrugated disk having an innermost edge and an outermost edge, wherein corrugation forms progressive rings to and from said innermost and outermost edges;

2) said innermost edge of said intermediate spider connected to upper end of said voice coil former of said speaker assembly;

3) said outermost edge of said intermediate spider connected to said frame of said speaker assembly;

c) a linear spider;

1) said linear spider comprising a longitudinally corrugated cylindrical annulus having an upper end and a lower end;

2) said lower end of said longitudinally corrugated cylindrical annulus connected to a pole piece of said speaker assembly;

3) a cone of said speaker assembly converging upon said upper end of said longitudinally corrugated cylindrical annulus.

4. An inner suspension system for a speaker assembly as mentioned in claim 2, wherein said center spider, said intermediate spider, and said linear spider are made of an open-weave cloth impregnated with phenolic resin and formed under heat.

* * * * *